United States Patent [19]

Bokelman

[11] 3,942,913

[45] Mar. 9, 1976

[54] ROTATING CYLINDER WHEEL AND BALL-PISTON WHEEL MOTOR, GENERATOR, AND PUMP ASSEMBLY

[76] Inventor: Raymond Frank Bokelman, 9412 Royal Palm, Garden Grove, Calif. 92640

[22] Filed: Jan. 10, 1974

[21] Appl. No.: 432,421

[52] U.S. Cl. ..... 417/273; 91/491; 310/24

[51] Int. Cl.[2] ..... F04B 1/12

[58] Field of Search ..... 91/472, 493, 491, 490; 418/191; 123/44 R, 8.23, 8.45, 8.47; 192/60, 59; 310/23, 24; 290/1; 417/269–273

[56] References Cited

UNITED STATES PATENTS

| | | | |
|---|---|---|---|
| 1,131,614 | 3/1915 | Radtke | 310/24 |
| 1,347,002 | 7/1920 | Baule | 310/24 |
| 1,356,290 | 10/1920 | Kellum | 310/24 |
| 1,456,694 | 5/1923 | Ingraham | 418/191 |
| 1,960,035 | 5/1934 | Warren | 91/490 |
| 1,992,040 | 2/1935 | Rodgers | 192/60 |
| 3,105,153 | 9/1963 | James, Jr. | 290/1 |
| 3,206,609 | 9/1965 | Dawes | 290/1 |
| 3,237,613 | 3/1966 | Mosovsky | 418/191 |
| 3,676,719 | 7/1972 | Pecci | 310/24 |
| 3,703,653 | 11/1972 | Tracy | 310/24 |

FOREIGN PATENTS OR APPLICATIONS

| | | | |
|---|---|---|---|
| 239,918 | 1/1945 | Switzerland | 91/491 |

*Primary Examiner*—William L. Freeh
*Attorney, Agent, or Firm*—Raymond L. Madsen

[57] ABSTRACT

There is disclosed a cylinder wheel connected in rotary engagement with a ball-piston wheel, the cylinder wheel having a multiplicity of cylindrical cavities, each cavity having at least one coil with a plurality of electrically conductive turns circularly disposed therearound. The ball-piston wheel has a multiplicity of balls of magnetic material or permanent magnets which engage the cylindrical cavities. The coils may be periodically activated by selectively applying electric current thereto to sequentially propel each ball into and out of the respective cylindrical cavity thereby turning the cylinder wheel and ball-piston wheel in rotating motion. When the balls are magnets, and the cylinder and ball-piston wheel assembly is rotated by an external driving means, a voltage is induced in each coil as a permanent magnet ball passes therethrough thereby forming an electric generator. When the coils are sequentially activated by an electric current to operate the cylinder wheel and ball-piston assembly as an electric motor, the entire assembly may be immersed in a fluid and a hollow shaft inserted into a central opening in the cylinder wheel which successively communicates with each of the cylindrical cavities to provide a positive displacement pump whereby each ball entering a cylindrical cavity forces the fluid contents of the cavity into and through the interior of the hollow shaft.

4 Claims, 10 Drawing Figures

ROTATING CYLINDER WHEEL AND BALL-PISTON WHEEL MOTOR, GENERATOR, AND PUMP ASSEMBLY

The present invention relates to rotary motors, generators, and pumps and more particularly to a rotating cylinder wheel and ball-piston wheel motor, generator, and pump assembly.

In the field of cylinder wheel and ball-piston wheel assemblies where the ball-pistons of the ball-piston wheel are successively engaged in rotation in the cylinder of the cylinder wheel (U.S. Pat. No. 3,237,613, issued to C. N. Mosovsky and French Pat. No. 1,314,670 issued to M. Gassot), it has been the general practice to employ combustible fuels inserted into the cylinders of the cylinder wheel which is ignited to propel the balls of the ball-piston wheel out of the cylinders to rotate the assembly. Although use of such a method of propulsion has served the purpose, it produces undesirable products of combustion along with objectionable heat and annoying noise. Those concerned with the development of rotating cylinder and ball-piston wheel assemblies have long recognized the need for eliminating combustible or pressurized fuel to propel the assembly. The present invention fulfills this need.

In the prior art rotating cylinder wheel and rotating ball-piston wheel assemblies, pressurized fuel such as ignited combustible fuel or fluid under pressure have been used to propel the rotating assembly. Therefore, it was impossible to utilize the rotating assembly as a submersible pump without providing some external power to rotate the assembly. The present invention is self-propelled and at the same time can be utilized as a submersible pump without an external driving source.

The general purpose of this invention is to provide a cylinder wheel and ball-piston wheel assembly which embraces all the advantages of similarly employed rotating assemblies and possesses none of the aforedescribed disadvantages. To attain this, the present invention contemplates a unique coil arrangement around each cylindrical cavity of the cylinder wheel whereby the balls of the ball-piston wheel engaged by each cavity are magnetically propelled to rotate the assembly.

An object of the present invention is the provision of an electrically propelled ball-piston and cylinder wheel assembly.

Another object is to provide electromagnetic propulsion of the balls of the ball-piston wheel in rotary engagement with the cylinder wheel.

A further object of the invention is the provision of a ball-piston wheel and cylinder wheel assembly which is electromagnetically driven as a submersible pump.

Yet another object of the present invention is the provision of a rotary ball-piston wheel and cylinder wheel assembly which operates as an electric motor.

A still further object is a ball-piston wheel and cylinder wheel assembly which operates as an electrical generator.

Yet still another object is the provision of a ball-piston wheel and cylinder wheel assembly which is a self-driven positive displacement pump.

Another further object of the invention is the provision of a ball-piston wheel and cylinder wheel assembly which is rotated by pressurized fluid.

Other objects andmany of the attendant advantages of this invention will be readily appreciated as the same becomes better understood by reference to the following detailed description when considered in connection with the accompanying drawings in which like reference numerals designated like parts throughout the figures thereof and wherein:

FIG. 1*a* shows a plan view of a preferred embodiment of the invention;

FIG. 1*b* illustrates a pictorial view in section and partly in schematic of the central portion of the cylinder wheel containing the electrical contacts and electrodes;

FIGS 2*a* and 2*b* illustrates a cross-sectional view of the cylindrical cavity of the cylinder wheel of FIG. 1 showing the numerical sequence of the positions of the ball-piston as it moves therein;

Figure 7:
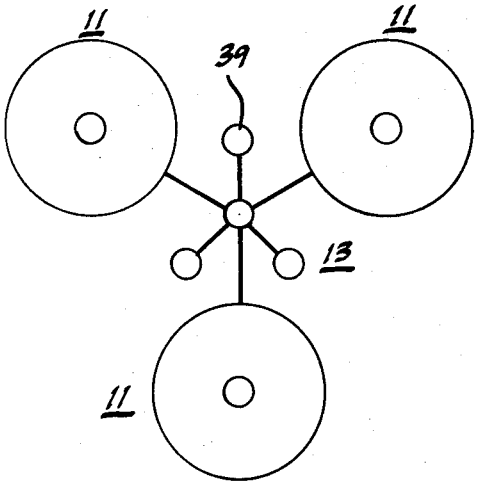

FIGS. 7*a* and 7*b* illustrate multiple cylinder wheels and multiple ball-piston wheel assemblies.

Figure 1:
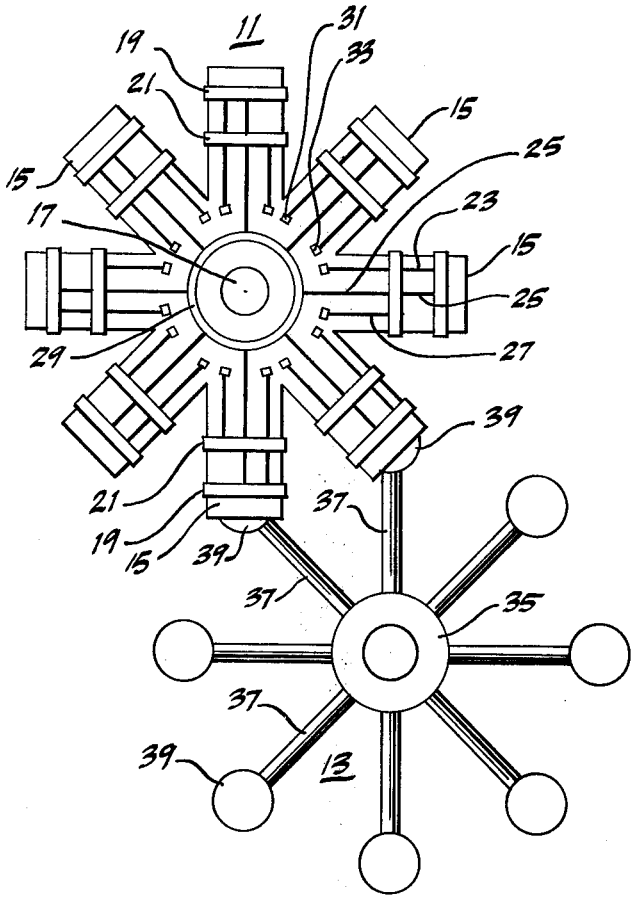
Figure 1:
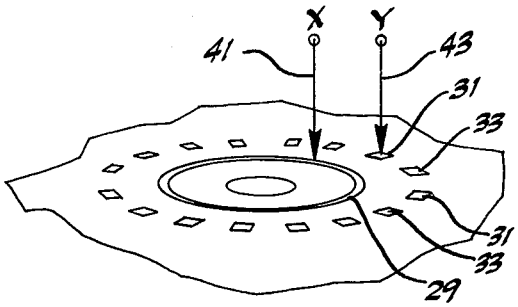

Referring now to the drawings wherein like reference characters designate like or corresponding parts throughout the several views, there is shown in FIG. 1 *a* a cylinder wheel 11 and ball-piston wheel 13 in rotary engagement, cylinder wheel 11 having a multiplicity of cylinders 15 with cylindrical cavities therein and a central opening or shaft opening 17. Each cylinder 15 and cylindrical cavity has coils 19 and 21 having a multiplicity of conductive turns circularly disposed or wound therearound. Coil 19 has connecting wire 23 and connecting wire 25 attached thereto while coil 21 is also connected to connecting wire 25 and as well as connecting wire 27. Connecting wire 25 is further connected to slip-ring 29 symmetrically located about shaft opening 17. Connecting wire 23 is connected to contact segment 31 and connecting wire 27 is connected to contact segment 33, segments 31 and 33 being circularly located about the slip-ring 29. Although the slip-ring and contact segment configuration are adequate to make electrical contact to each of the coils, other well known contacting means can be used to activate the coils. It is also contemplated to employ cam operated microswitches to activate each coil. Power can be continuously applied through slip-rings to the microswitches and each microswitch successively operated by a cam to apply power to a coil associated therewith as the cylinder wheel rotates.

Ball-piston wheel 13 has a central hub 35 to which are attached a multiplicity of spokes or shafts 37 at the extreme ends of which are mounted ball-pistons 39 made of magnetic material or its equivalent. Each of the ball-pistons 39 successively engage the multiplicity of cylinders 15 of cylinder wheel 11, as the ball-piston wheel and cylinder wheel assembly rotates.

FIG. 1*b* shows electrodes 41 and 43 in schematic form connected from terminals X and Y and contacting annular slip-ring 29 and contacting segment 31 of a segmented annular slip-ring, respectively.

Figure 2:
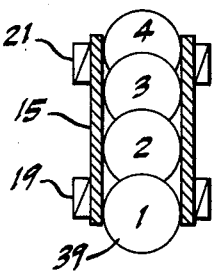
Figure 2:
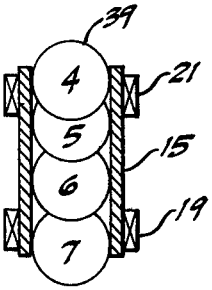

Turning now to FIGS. 2*a* and 2*b*, cylinder 15, along with coils 19 and 21 are shown in cross-section. Ball-piston 39 is shown in positions 1–7 illustrating a sequence of numbered positions of the ball-piston within the cylinder to assist in explaining the operation of the invention relative to the activation of coils 19 and 21.

Figure 3:
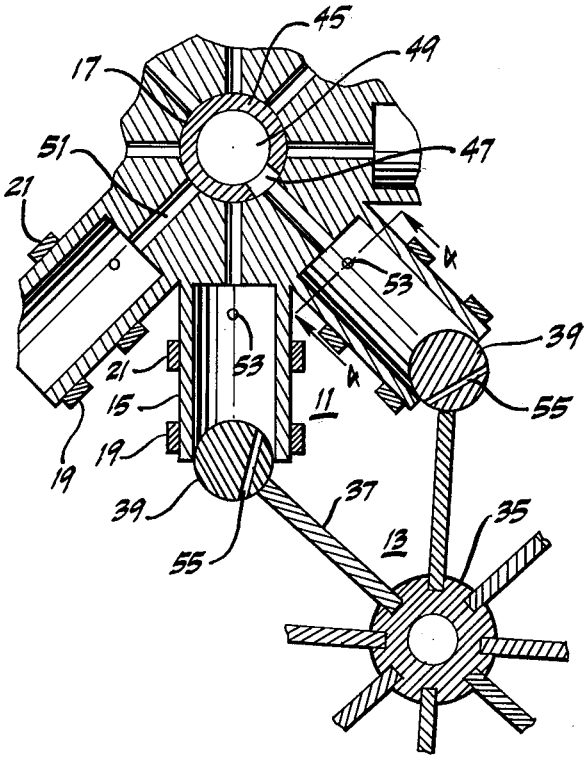
FIG. 3 shows a cross-sectional view, partly in section, of the preferred embodiment illustrated in FIG. 1 adapted to be operated as a submersible pump.

In FIG. 3, a pump or hydraulic motor configuration is illustrated where cylinder wheel 11 and ball-piston 13 of FIG. 1 are shown in cross-section, cylinder wheel 11 rotating on shaft 45 which is located in central opening 17. Shaft 45 has a central opening or hollow or interior 49 through which fluids may be conducted. An opening 47 is located in the shaft which communicates between the shaft interior and a conduit 51 which in turn is connected with the cylindrical cavity of cylinder 15. Each cylindrical cavity has a pressure relief opening 53 and 57 (FIG. 4) therein. As an alternate pressure relief configuration, ball-piston 39 may have an opening or conduit 55 therethrough which provides a pressure relief opening similar to opening 53.

Figure 4:
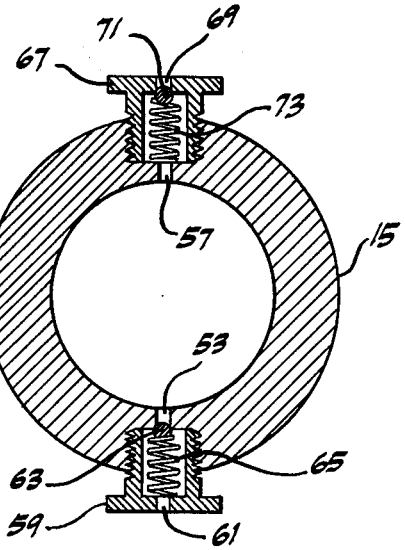
FIG. 4 illustrates a cross-section view of one of the cylinders of the cylinder wheel of FIG. 3 showing pressure relief valves.

FIG. 4 shows a cross-section of cylinder 15 taken on line 4—4 of FIG. 3 in the direction of the arrows. Fitting 59 is threadably engaged in opening 53 in the wall of cylinder 15 and has contained in the interior cavity thereof ball valve 63 biased by spring 65 to close opening 61 therein which also closes opening 53 in cylinder 15. Similarly, fitting 67 is threadably engaged in opening 57 in the wall of cylinder 15, fitting 67 having opening 69 therethrough which is closed by ball valve 71 biased against opening 69 by spring 73 thereby also closing opening 57.

Figure 5:
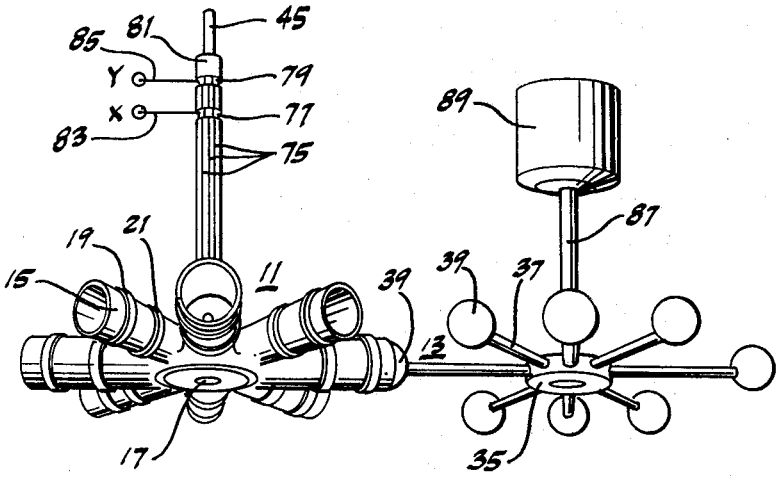
FIG. 5 shows a pictorial view of the ball-piston and cylinder wheel assembly of FIG. 1 connected as a generator.

FIG. 5 illustrates cylinder wheel 11 and ball-piston wheel 13 utilized as a generator. Cylinder wheel 11 is fixedly connected to hollow shaft 81 which has a plurality of connecting wires 75 on the surface thereof which are electrically connected to the multiplicity of coils wound around cylinder 15 and further connected to segmented slip-rings 77 and 79 which in turn contact in sliding engagement electrodes 83 and 85, shown schematically. Hollow shaft 45 is slidably located within hollow shaft 81 and supports the entire cylinder wheel assembly. Ball-piston wheel 13 has central hub 35 connected to shaft 87 which in turn is connected to motor 89. Ball-pistons 39 are permanent magnets or electromagnets such that when ball-piston wheel 13 is rotated, magnet balls 39 enter cylinder 15 nd induce a voltage and current in coils 19 and 21 wound therearound. The electrical voltage output of the coils appears at terminals X and Y connected to electrodes 83 and 85.

Figure 6:
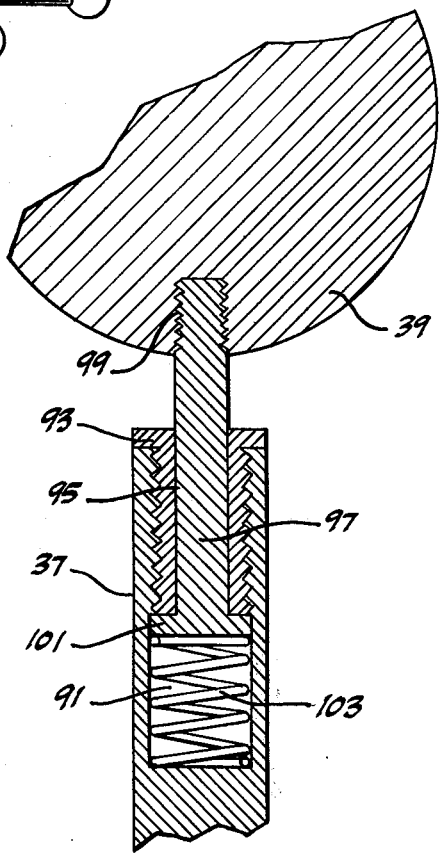
FIG. 6 illustrates a cross-section view of a spring loaded ball-piston.
Figure 7:
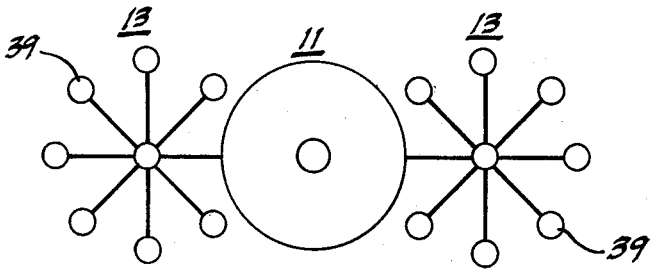

FIG. 6 shows in cross-section ball-piston 39 threadably engaged to slidable shaft 97 mounted in opening 91 at the end of shaft or spoke 37. Fitting or bushing 93 is threadably engaged in opening 91, and has central opening 95 therethrough into which shaft 97 is slidably inserted and retained therein by shoulder 101. One end of slidable shaft 97 has threads 99 thereon which threadably engage ball-piston 39. Spring 103 biases shoulder 101 of shaft 97 against the threaded end of bushing 93 to keep ball-piston 39 slidably extended from the end of shaft 37.

FIG. 7*a* illustrates three cylinder wheels 11 in simultaneous engagement with a single ball-piston wheel 13. Similarly, FIG. 7*b* illustrates two ball-piston wheels 13 in rotary engagement with a single cylinder wheel 11. Although FIGS. 7*a* and 7*b* illustrate a particular configuration of ball-piston and cylinder wheel combinations, it should be realized that other combinations of cylinder wheel and ball-piston wheel assemblies are possible. The number of balls on a given ball-piston wheel and the number of cylinders in a cylinder wheel in rotary engagement therewith are variable design parameters which give the designer wide latitude of choice. It should also be noted that a multiplicity of cylinder wheels can be attached to one shaft and each be engaged by one or more ball-piston wheels to form a multiplicity of rotating assemblies in parallel.

Operation of the invention can best be described by referring to FIGS. 1*a*, 1*b*, 2*a*, and 2*b*. When ball-piston 39 is adjacent the opening of cylinder 15, shown as position 1 of FIG. 2*a*, coil 19 is energized by providing source of voltage and current to terminals X and Y which activates coil 19 through electrodes 41 and 43, slip-ring 29 and segment 31 and conducting leads 23 and 25. Ball-piston 39, made from magnetic material, is then drawn to the center of coil 19 by the magnetic field produced therein. At the point where ball-piston 39 reaches the center of coil 19, the electrical excitation is removed from the coil by electrode 43 ceasing to make contact with segment 31. However, the momentum imparted to ball-piston 39 continues to carry it past the center of coil 19 and on toward coil 21 as illustrated by position 2 of FIG. 2*a*. At this point, the cylinder wheel rotates to position 3 of FIG. 2*a* where electrode 43 makes contact with segment 33 and activates coil 21 producing a magnetic field therein which forces ball-piston 39 toward the center of coil 21. As ball-piston 39 reaches the center of coil 21 the electrical excitation is removed and the momentum imparted to ball-piston 39 causes it to continue past the center of coil 21 to its point of deepest penetration in cylinder 15 designated by position 4 in FIGS. 2*a* and 2*b*. Another set of electrodes (not illustrated) similar to 41 and 43 of FIG. 1*b* can be located in respect to segments 31 and 33 such that as the ball-piston 39 reverses its motion and beings to exit from cylinder 15, coil 21 is again activatd to move ball-piston 39 from position 4 of FIG. 2*b* toward the center of coil 21. Again, as the ball-piston 39 reaches the center of coil 21, the excitation is removed therefrom and the ball-piston 39 continues to move past the ceter into position 5 of FIG. 2*b*. At this point, coil 19 is again activated by still another set of electrodes, not illustrated, similar to electrodes 41 and 43, to force ball-piston 39 from position 5 to position 6 of FIG. 2*b* toward the center of coil 19. As ball-piston 39 reaches the center of coil 19, the excitation is removed therefrom and the momentum of ball-piston 39 continues to move ball-piston 39 past the center of coil 19 into position 7 of FIG. 2b and thereafter to exit from cylinder 15, completing the cyclic engagement with cylinder 15. Each ball-piston successively engages a cylinder of the cylinder wheel as described above to provide the rotating motion to the assembly. Thus, the reciprocating motion of the ball-piston is converted into rotary motion. As one ball-piston leaves a cylinder, another ball engages another cylinder to keep the ball-piston wheel and cylinder wheel in mechanical synchronization.

It should be clear that in the description above that ball-piston 39 can also be a permanent magnet or electromagnet and the magnetic field set up in coils 19 and 21 can be polarized in such a direction to attract or repel ball-piston 39 so that the ball-piston can be attracted toward the center of the coil and then after passing through the center can be repelled from the coil by reversing the magetic field, thereby creating additional propelling forces to act upon the ball-piston. It must be remembered that as the speed of rotation increases, the rate of excitation of the coils producing the magnetic field increases makig the inductance of the coils more of a problem. Although the complete excitation system for the coils is not shown, it should be clear from the example illustrated in FIG. 1b that any system of electrodes, slip-rings, cam operated microswitches, conducting segments, inductive and capacitive coupling and the like can be utilized to excite the coils in their proper sequence, these methods being well known in the field of rotating electrical apparatus such as motors and generators and are easily adapted to exciting the coils of this invention.

Operation of the present invention as a positive displacement pump can best be understood by referring to FIG. 3 which shows a cross-section of the cylinder wheel and ball-piston wheel where the cylinder wheel rotates on hollow shaft 45. Assuming that the rotation of the cylinder wheel is clock-wise and the ball-piston wheel is counterclockwise, ball-piston 39 enters cylinder 15 while cylinder 15 and its conduit 51 are aligned with opening 47 in shaft 45. Therefore, as ball-piston 39 is drawn into cylinder 15 by the magnetic field of coils 19 and 21, the contents of cylinder 15 are forced through conduit 51 and opening 47 into interior 49 of shaft 45. Since the displacement of ball-piston 39 in cylinder 15 may be accurately known, a precision metering pump is formed by the cylinder wheel and ball-piston wheel rotating assembly. It should be clear that by immersing the entire assembly of the cylinder wheel and ball-piston wheel into a fluid, the assembly can be utilized to accurately pump precise quantities of fluid surrounding the assembly through the cylinders and the hollow shaft to some collection point.

As the cylinder wheel rotates on shaft 45 conduit 51 is closed by the wall of the shaft after conduit 51 progresses past the extremities of opening 47. Conduit 51 is shut off by this rotating action at the point where ball-piston 39 is at its deepest penetration in cylinder 15. Therfore, it is necessary to remove the pressure or vacuum seal created by the withdrawal of ball-piston 39 from the interior of cylinder 15. Opening 57 is provided with the ball valve assembly illustrated in FIG. 4 to allow conduction of fluid therethrough as the ball-piston is removed from cylinder 15 thereby breaking the vacuum seal and allowing the ball to egress therefrom without extreme fluid pressure forces. The ball valve assembly connected with opening 53 prevents excessive pressure from being built up in cylinder 15 as ball-piston 39 is drawn into the interior thereof, and is a pressure safety relief valve. The spring associated with the pressure safety relief valve is adjusted to relieve excessive pressure as the ball enters the cylinder and has a spring force which is adjusted to a level greater than the normal fluid pressures that would be encountered in the free flowing fluid conditions created in a pump application but not great enough to cause internal pressures to build up in cylinder 15 which might cause it to explode.

An alternate to the pressure relief ball valve assembly illustrated in FIG. 4 is conduit 55 through ball-piston 39. As illustrated in FIG. 3, the conduit is drilled at an angle through ball-piston 39 such that as the ball-piston enters cylinder 15, conduit 55 does not communicate with the interior of the cylinder. Upon reaching the point of deepest penetration, the rotation of the cylinder wheel and the ball-piston wheel results in conduit 55 becoming aligned in the cylinder to establish a conduction path through conduit 55 from the interior of the cylinder to the exterior thereof. Consequently, as the ball exits from the cylinder, the pressure forces produced by the ball-piston's removal from the cylinder are relieved through conduit 55 and the ball is easily removed therefrom.

The structure of FIG. 3 can also be operated as a hydraulic motor by reversing the fluid flow through the system and realigning opening 47 in shaft 45 so that the interior of shaft 45 communicates through opening 47 and conduit 51 with the interior of cylinder 15 only after ball-piston 39 engaged therein has reached its deepest point of penetration and begins to reverse its motion in the cylinder. Fluid under pressure applied to shaft 45 flows through opening 47 and conduit 51 into cylinder 15 to force ball-piston 39 therefrom. As the ball-piston leaves the cylinder, the rotation of the assembly moves another ball-piston opening 47 past conduit 51 and the fluid path from the interior of shaft 45 to the cylinder is closed. The momentum of the rotary motion carries the next adjacent ball-piston into another cylinder to the point of deepest penetration where opening 47 is aligned with conduit 51 of that cylinder to conduct the fluid into trhe cylinder to force the ball-piston therefrom. Additional momentum can be obtained from flywheels or other rotating masses. As the ball-piston enters a cylinder, a pressure forces build up since the cylinder is not aligned with opening 47 until the ball-piston reaches the point of deepest penetration. Therefore, as in the pump configuraton, pressure relief valves, such as illustrated in FIG. 4, are required.

Another application of the present invention is an electrical generator as illustrated in FIG. 5. Here, ball-pistons 39 are made of permanent magnets or electromagnets and ball-piston wheel 13 is turned by an external driving means such as motor 89 attached to hub 35 of ball-piston wheel 13 by shaft 87. It should be noted that ball-piston wheel 13 could be free wheeling or free running and the motor drive attached to cylinder wheel 11 to turn shaft 81 connected thereto. It should also be noted that the driving force for the assembly can be provided by pressurized fuel such as compressed air, steam, hydraulic fluid, or combustible fuel and the like to rotate the cylinder and ball-piston wheel assemblies. As ball-piston magnet 39 enters cylinder 15, the magnetic field therefrom induces a voltage in coils 19 and 21 as the lines of magnetic flux intercept the conductive turns of the coils. The multiplicity of conducting wires 75 connected to the coils terminate in slip-rings 77 and 79 which have segments thereof associated with each wire coming from each coil. Therefore, as a ball-piston enters the cylinder and exits therefrom, electrodes 83 and 85 are appropriately connected to the coil at the point where the ball-piston induces a voltage therein. It should be clear that a multiplicity of electrodes may be utilized to connect the coils at various points of rotation to take advantage of the voltages induced by both the ball-piston magnet entering the cylinder and leaving the cylinder. It should be clear that other configurations and methods of electrical connection can be utilized to make contact with the coils such as cam operated microswitches and capacitive and inductive coupling and the like and the arrangement illustrated in FIG. 5 merely illustrates one of many methods and configuration which may be employed.

It is clear to one skilled in mechanical rotation and devices of a piston and cylinder nature, that not more than one ball can be engaged in a cylinder at one time and as one ball enters one cylinder, another ball which was previously engaged by another cylinder must leave that cylinder.

The reason for such a restriction is that if two balls are firmly engaged at the same time, the rotation of the wheels creates binding forces on the ball-pistons since the paths followed by the ball-pistons and the cylinders are not identical. However, to keep mechanical synchronism between the cylinder wheel and the ball-piston wheel, it is desirable that as one ball leaves a cylinder, another ball enters and therefore there is a short interval when both ball-pistons are engaged by the cylinders of the cylinder wheel. It is possible under these circumstances extreme wear can be encountered upon the ball-pistons or on the cylinder walls at the openings thereto. To overcome this difficulty, the spring loaded or biased ball-piston assembly of FIG. 6 is employed. Therefore, as forces are exerted upon the ball-piston 39, these forces are absorbed by spring 103 as the shaft 97 slides downwardly through bushing 93. By utilizing this spring loaded mounting scheme for the ball-pistons, two balls may be engaged simultaneously for short intervals by the cylinders to maintain synchronization of the cylinder wheel and the ball-piston wheel in rotating engagement.

Although only one cylinder wheel and one ball-piston wheel have been illustrated in the figures, FIGS. 7*a* and 7*b* illustrate combinations of multiple cylinder wheels and multiple ball-piston wheels which may be utilized. In FIG. 7*a* three cylinder wheels are illustrated working and rotating with one ball-piston wheel while in FIG. 7*b* two ball-piston wheels are shown in rotary engagement with one cylinder wheel. It should be realized that other combinations of cylinder wheels and ball-piston wheels can be realized for both increasing the power and the smoothness of rotation. Separation ball-piston and cylinder wheel assemblies of the nature illustrated in FIGS. 7*a* and 7*b* may be coupled together in parallel operation connecting the ball-piston wheels on a common shaft thereby obtaining more power if the system is used as a motor or more pumping capacity if the system is used as a pump. Cylinder wheels can also be coupled together for the same purpose. The possibility of arrangement of this nature is limited by the imagination of the designer.

Another application of the embodiment illustrated in FIG. 3 is a hydraulic brake. When used as a pump, the viscous nature of the fluid along with the confined flow of the fluid through the various ports and conduits opposes the motion of each ball-piston within the cylinders. By attaching a valve to the shaft to control the flow of fluid, more or less pressure can be applied to the ball-piston to create a variable braking force which opposes the rotary motion of the assembly. By attaching apparatus which is to be slowed or stopped to the rotating assembly of the ball-piston and cylinder wheels, the apparatus can be controlled by the braking action produced by the hydraulic forces produced on the ball-pistons moving in the cylinders.

It now should be apparent that the present invention provides a mechanical rotary wheel arrangement which may be employed in conjunction with an electric motor, generator, and pump assembly for obtaining unique combined operations of electromagnetic rotating devices and cylinder piston devices in a combination providing new and useful results.

Although particular components, etc., have been discussed in connection with a specific embodiment of a rotating assembly constructed in accordance with the teachings of the present invention, others may be utilized. Furthermore, it will be understood that although an exemplary embodiment of the present invention has been disclosed and discussed, other applications and mechanical arrangements are possible and that the embodiments disclosed may be subjected to various changes, modifications, and substitutions without necessarily departing from the spirit of the invention.

What is claimed is:

1. In a ball and rotary assembly having a cylinder wheel and a ball-piston wheel in rotary engagement and wherein each ball-piston is connected to the end of a spoke extending radially from a central hub, the improvement comprising:

a plurality of ball-pistons, each being slidably attached to the end of a spoke;

stop means to prevent each ball-piston from slidably disengaging the spoke to which it is slidably attached; and bias means to keep each ball-piston extended against said stop means and to absorb portions tending to move each ball radially toward the central hub.

2. Apparatus comprising:

a cylinder wheel having a multiplicity of cylindrical cavities radially disposed around the circumference thereof and having a central opening therein to receive a shaft upon which said cylinder wheel rotates, said cylinder wheel having conduit means from each of said cylindrical cavities to the central opening for independently connecting each of said cylindrical cavities to said central opening;

a ball-piston wheel having a multiplicity of balls circularly disposed therearound, said ball-piston wheel being located in rotary engagement with said cylinder wheel, such that each ball of said ball-piston wheel sequentially engages and enters a cylindrical cavity of said cylinder wheel, each ball of said ball-piston wheel having a conduit passing therethrough and positioned therein so as not to connect the interior of the cavity with the exterior thereof as the ball penetrates into the cavity and to connect the interior of the cavity with the exterior thereof as the ball rotates and exits from the cavity; and driving means coupled to the assembly of said cylinder wheel and said ball-piston wheel to turn the wheels in rotary engagement.

3. The apparatus described in claim 2 wherein said balls of said ball-piston wheel are of magnetic material and said driving means comprises:

a multiplicity of coils having a plurality of electrically conducting turns, at least two of said coils being spaced apart and circularly disposed around one of each of said cylindrical cavities; and means for sequentially connecting an electric circuit to each of said at least two of said coils disposed around each of said cylindrical cavities, said electric circuit being connected to a coil when a ball of said ball-piston wheel is adjacent said coil, such that when an electric current is directed through said electric circuit and said coil, a magnet field is generated which tends to force said ball toward the center of said coil thereby propelling said ball from coil to coil through the cylindrical cavity and driving said cylinder wheel and said ball-piston wheel in rotary motion.

4. Apparatus comprising:

a cylinder wheel having a multiplicity of cylindrical cavities radially disposed around the circumference thereof;

a multiplicity of coils having a plurality of electrically conducting turns, at least two of said coils being spaced apart and circularly disposed around one of each of said cylindrical cavities;

a ball-piston wheel having a central hub with a plurality of identical spokes extending radially therefrom, each spoke having a central opening in the end thereof with spring bias means mounted in said opening, said ball-piston wheel having a multiplicity of balls of magnetic material, each ball having a shaft affixed thereto, said shaft being slidably engaged in a central opening of one of said plurality of identical spokes and against said spring bias means whereby when said ball-piston wheel is located in rotary engagement with said cylinder wheel, two of said plurality of balls simultaneously may engage cylindrical cavities of said cylinder wheel and the stresses therefrom are absorbed by the biased engagement of each ball with its respective spoke; and means for sequentially connecting an electric circuit to each of said at least two of said coils disposed around each of said cylindrical cavities, said electric circuit being connected to a coil when a ball of said ball-piston wheel is adjacent said coil, such that when an electric current is directed through said electric circuit and said coil, a magnetic field is generated which tends to force said ball toward the center of said coil thereby propelling said ball from coil to coil through the cylindrical cavity and driving said cylinder wheel and said ball-piston wheel in rotary motion.

* * * * *